US005648981A

United States Patent [19]

Miner, Jr. et al.

[11] Patent Number: 5,648,981

[45] Date of Patent: Jul. 15, 1997

[54] COOLING SYSTEM FOR A TWO COMPONENT FURNACE ROOF

[75] Inventors: Frank Henry Miner, Jr., North Olmsted; Mark Thomas Arthur, Lakewood, both of Ohio

[73] Assignee: UCAR Carbon Technology Corporation, Danbury, Conn.

[21] Appl. No.: 343,249

[22] Filed: Nov. 22, 1994

[51] Int. Cl.[6] ..... F27D 1/02

[52] U.S. Cl. ..... 373/74; 373/71; 373/73

[58] Field of Search ..... 373/71, 73, 74

[56] References Cited

U.S. PATENT DOCUMENTS 4,107,449 8/1978 Sosonkin et al. ..... 373/74

4,345,332 8/1982 Wronka ..... 373/74

4,815,096 3/1989 Burwell ..... 373/74

5,115,184 5/1992 Arthur et al. ..... 373/74

FOREIGN PATENT DOCUMENTS 2468863 9/1980 Germany .

*Primary Examiner*—Tu B. Hoang

*Attorney, Agent, or Firm*—Frederick J. McCarthy

[57] ABSTRACT

Two component spray cooled roof for electric furnaces to accommodate off-center electrode positions.

4 Claims, 5 Drawing Sheets

COOLING SYSTEM FOR A TWO COMPONENT FURNACE ROOF

The invention relates to a cover assembly for a vessel such as an electric arc furnace for melting metal in which said cover comprises a lower cover segment defining an opening above which a moveable upper cover segment is mounted. The moveable upper cover segment has an opening which is out of register with the opening of the lower cover segment and both the upper and lower segments have a bottom wall, an upstanding wall and a top wall defining an enclosed space wherein spray means are positioned to direct a spray of water for cooling the bottom walls.

BACKGROUND OF THE INVENTION

Electric arc furnaces for melting metal which utilize a single electrode frequently have to be positioned eccentrically, i.e. off-center in order to avoid overheating of the furnace in a particular quadrant due to arc deflection caused by the field generated by the arc current. The optimal off-center location of the electrode can vary due to the field strength so that a relatively wide opening in the furnace cover is required to permit movement of the electrode to the appropriate position. This situation, with a wide cover opening, is thermally inefficient and with furnace roof covers provided with embedded pressurized water cooling conduits there has been used a center piece with an eccentrically positioned smaller opening. The center piece is also provided with embedded pressurized water cooling conduits and is moveable to position the eccentric opening to the desired position. The foregoing arrangement has the disadvantages of having a pressurized conduit relatively close to the electrode and therefore the electode arc; in the event of arcing to the center piece, high pressure, high volume water leakage results.

SUMMARY OF THE INVENTION

The invention relates to a vessel, e.g. an electric arc furnace for handling a heated substance, e.g. molten metal, said vessel having a cover assembly comprising a lower cover defining an inner opening above which is slidably seated a moveable upper cover, said lower cover comprising a bottom wall, an upstanding peripheral wall and a top wall defining an enclosed space in said lower cover; first spray means comprising a plurality of tubes coupled to spray nozzles disposed within said enclosed space in said lower cover and arranged to direct a spray of coolant from the spray nozzles onto at least the bottom wall of said lower cover so as to maintain a desired temperature at said bottom wall; inlet means for bringing coolant to the tubes and spray nozzles of said first spray means; outlet means for removing the spent coolant from the enclosed space of said lower cover; said peripheral upper cover also comprising a bottom wall, an upstanding upper wall and a top wall defining an enclosed space in said upper cover; second spray means comprising a plurality of tubes coupled to spray nozzles disposed within said enclosed space of said upper cover and arranged to direct a spray of coolant from the spray nozzles of the second spray means onto at least the bottom wall of said upper cover so as to maintain a desired temperature at said bottom wall; inlet means for bringing coolant to the tubes and spray nozzles of said second spray means; outlet means for removing the spent coolant from the enclosed space of said upper cover.

The coolant inlet means for the upper cover is in communication with the coolant inlet means of the lower roof so that coolant flows from the coolant inlet means of the lower roof to the coolant inlet means of the upper roof. The spent coolant outlet means for the upper roof are in communication with the spent coolant means for the lower roof so that spent coolant flows by gravity from the upper roof to the lower roof and then the spent coolant exits the lower roof.

The upper roof which overlies and is supported by the lower roof has an inner opening which can be concentrically or eccentrically positioned with respect to the inner opening of the lower roof in order to minimize thermal stress as hereinafter described when an electrode of the electric furnace is lowered through the inner openings of the upper roof and lower roof.

In a particular embodiment of the present invention a portion of the top wall of the lower roof which is spaced inwardly from the upstanding peripheral wall and surrounds the inner opening is in the form of the flat shelf-like segment. The upper roof is slidably moveably seated on this flat shelf-like segment so that the inner opening of the upper roof can be placed in the most thermally advantageous position above the inner opening of the lower roof.

DETAILED DESCRIPTION OF THE INVENTION

Figure 1:
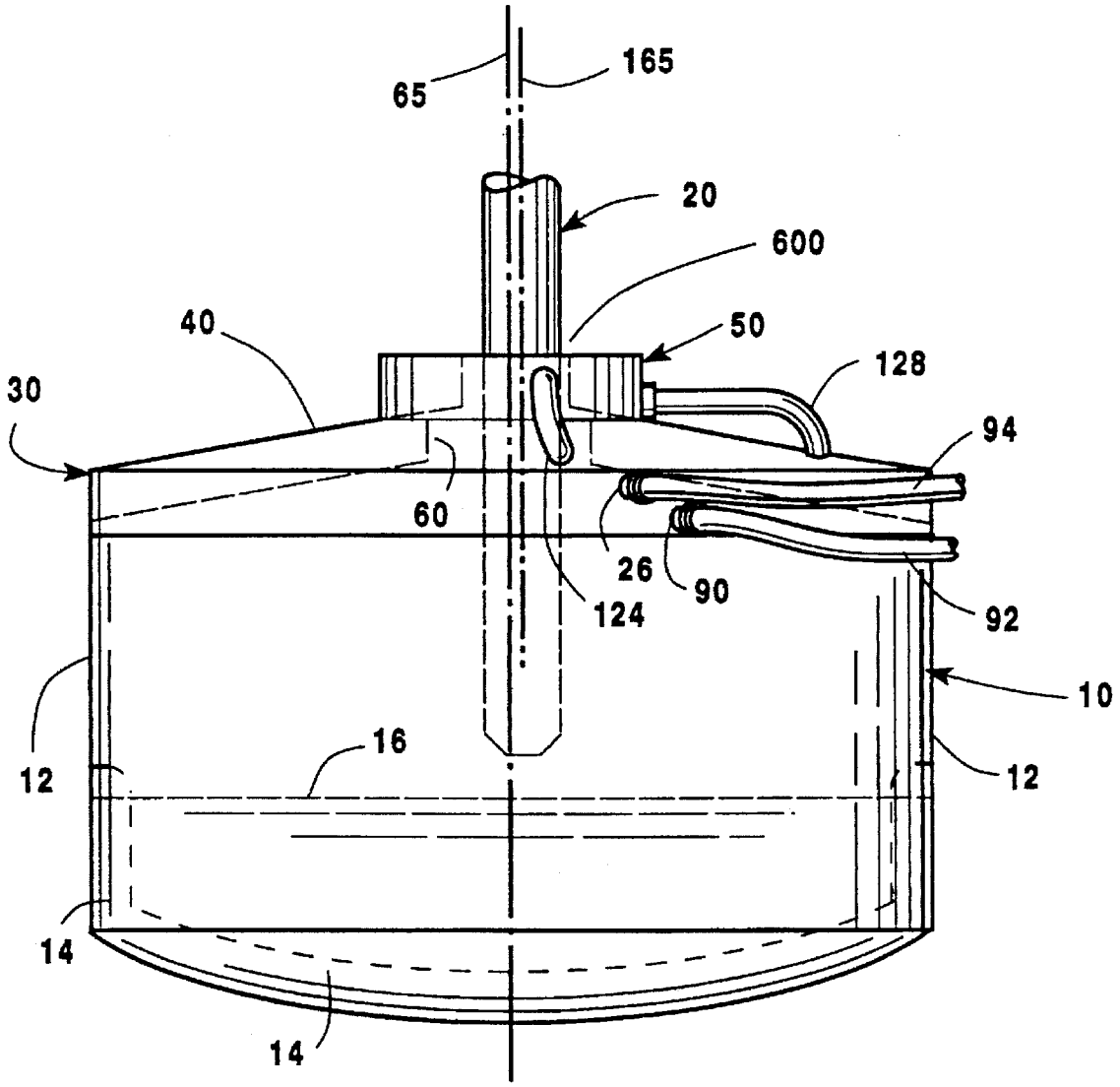
FIG. 1 is a side view of an electric arc furnace having a cover assembly embodying the present invention.

With reference to FIG. 1, an electric arc furnace is shown at 10 having a vertically extending electrode 20 supported by conventional supporting means (not shown). Arc furnace 10 comprises a steel shell 12 the lower portion of which is lined with refractory 14 which contains molten metal 16. The cover assembly 30 for arc furnace 10 includes a lower cover 40 and an upper cover 50. The lower cover 40 is seated on and directly overlies the steel shell 12 of electric arc furnace 10 and defines a relatively wide central opening 60 in the lower cover 40 through which electrode 20 passes. The opening 60 of lower cover 40 needs to be relatively wide compared to the width of electrode 20 since, as is well known in the art, it is frequently the case that electrode 20, having a longitudinal central axis 165, is required to be positioned eccentrically, i.e. off-center with respect to the central longitudinal axis 65 of opening 60, as indicated at 165, in order to avoid excessive temperatures in a particular quadrant of the furnace. In order to enable a relatively complete closure of the furnace, while still permitting eccentric positioning of the electrode 20, the upper laterally moveable cover 50 is provided, which has an opening 600 which can closely surround electrode 20. Upper cover 50 is slidably moveable laterally on supporting lower cover 40 and thus can accommodate a wide variation of off-set electrode positions.

Figure 2:
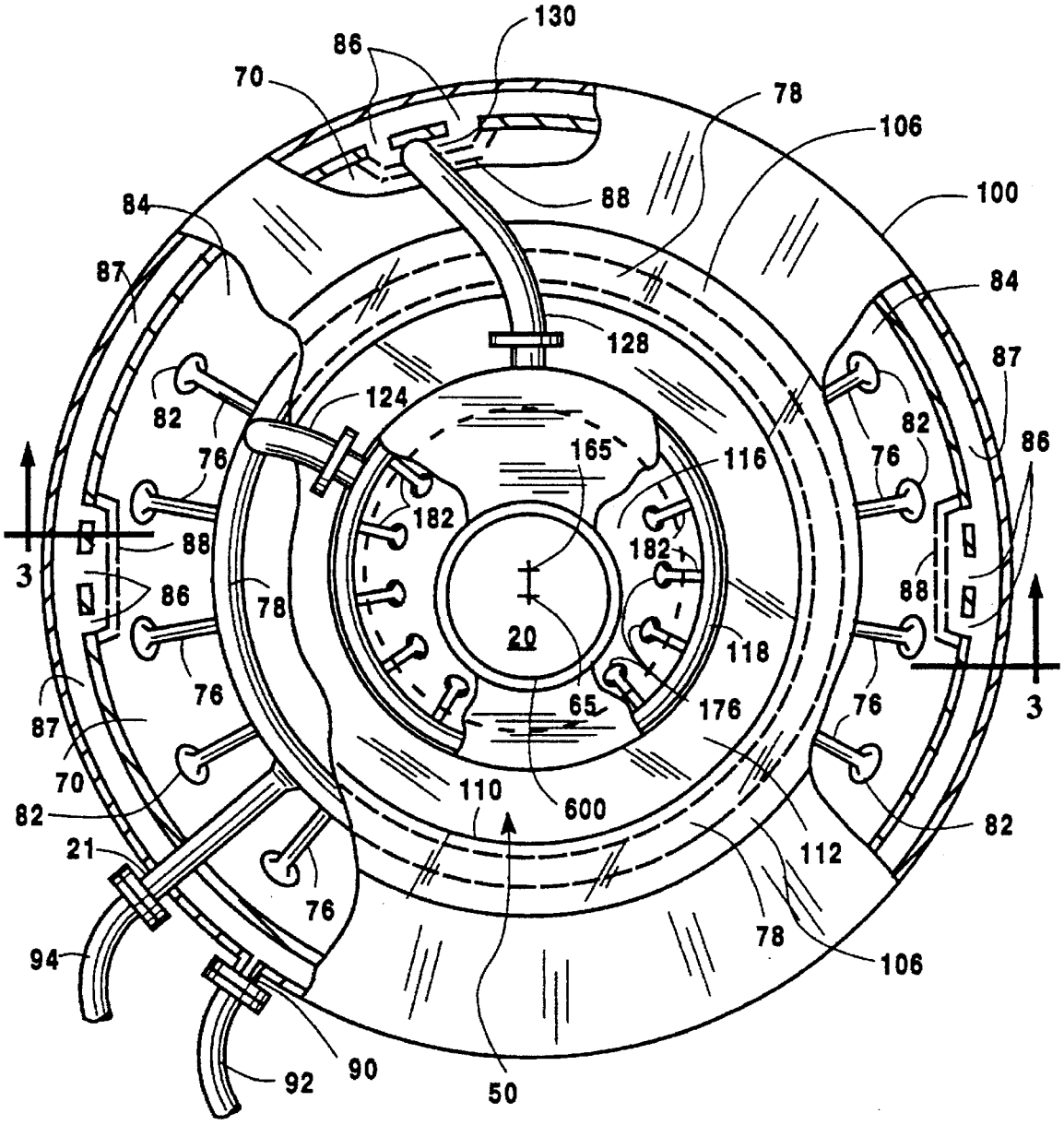
FIG. 2 is a plan view of an electric arc furnace cover assembly of the present invention, partially cut-away and partially in section, showing the interior of the furnace cover assembly.
Figure 3:
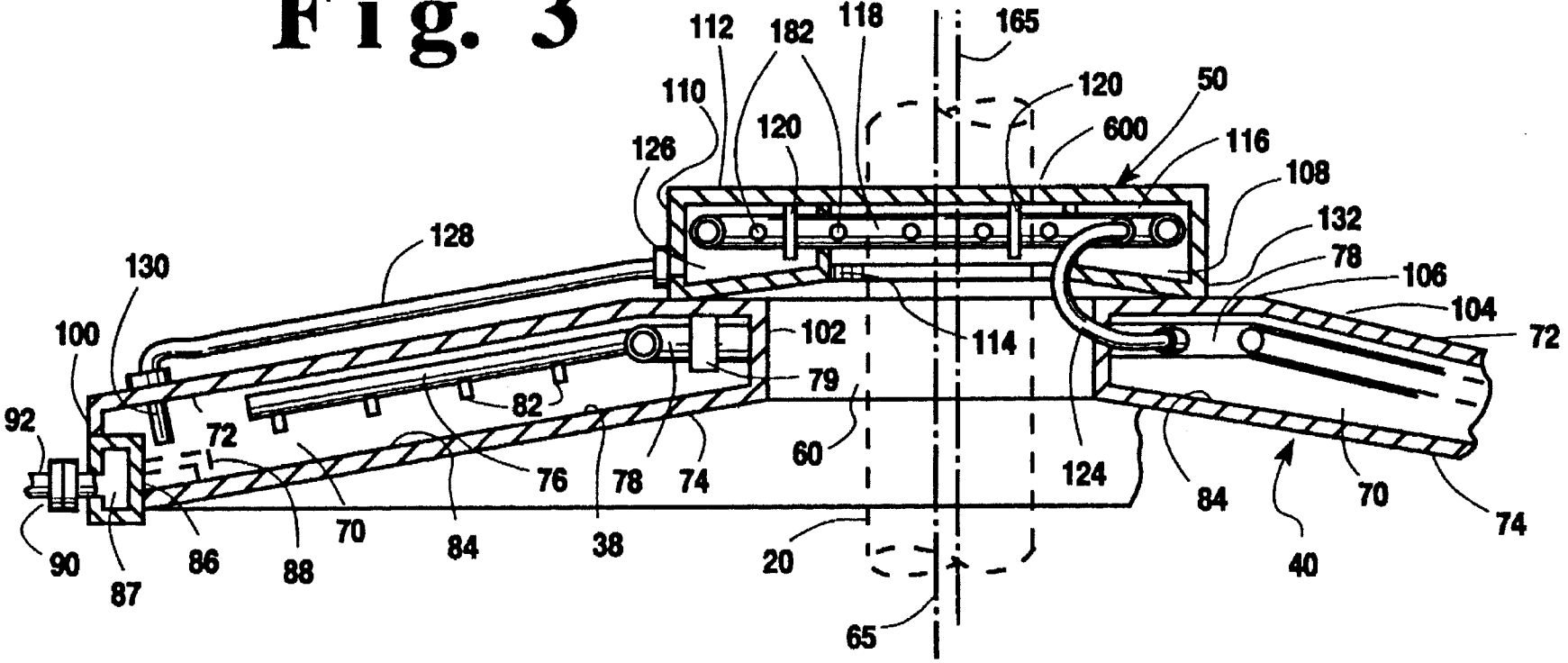
FIG. 3 is a side elevation sectional view of the portion of the furnace cover along lines 3—3 of FIG. 2.
Figure 4:
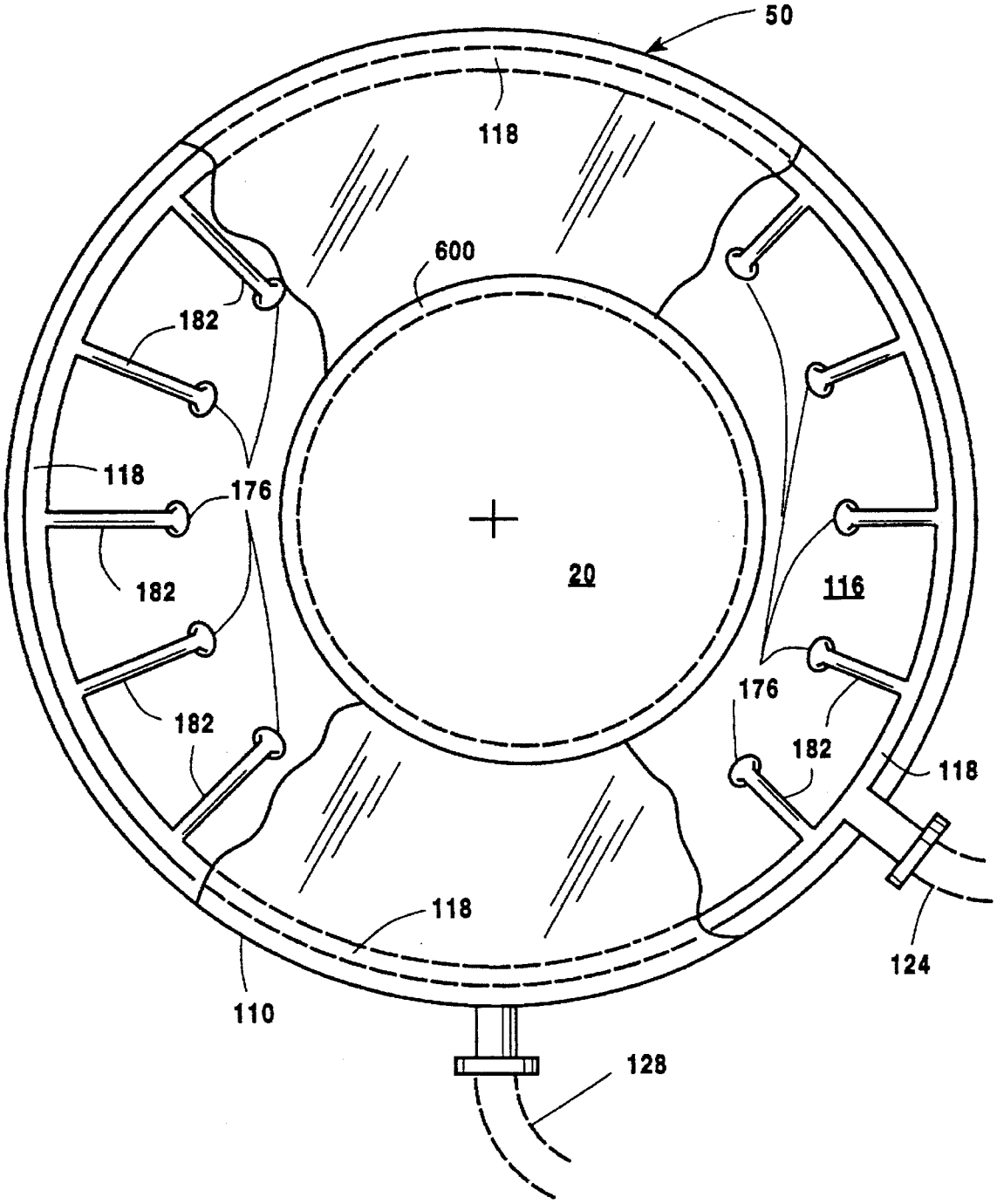
FIG. 4 is a plan view of the upper furnace cover partly in section.
Figure 5:
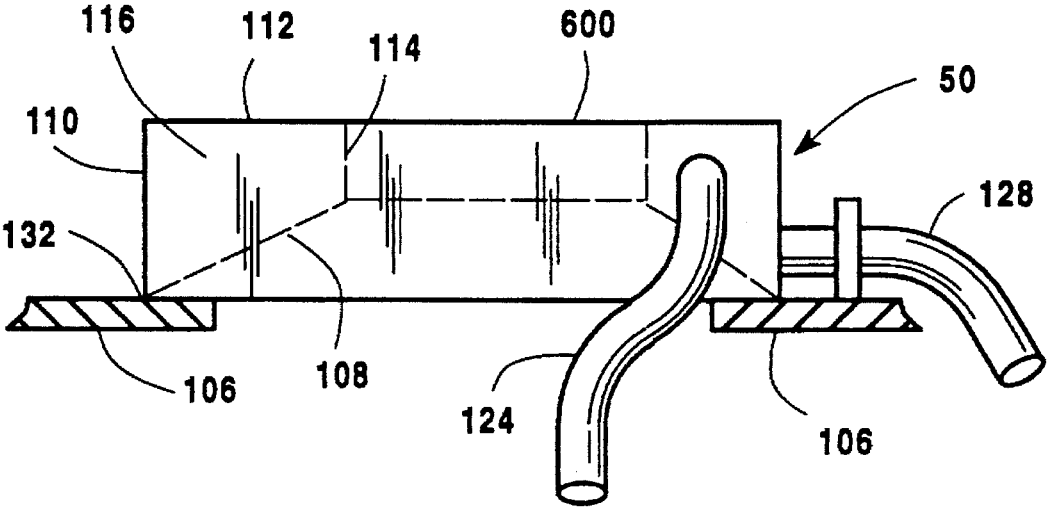
FIGS. 5 and 6 are respectively elevation and plan views of the upper furnace cover.
Figure 6:
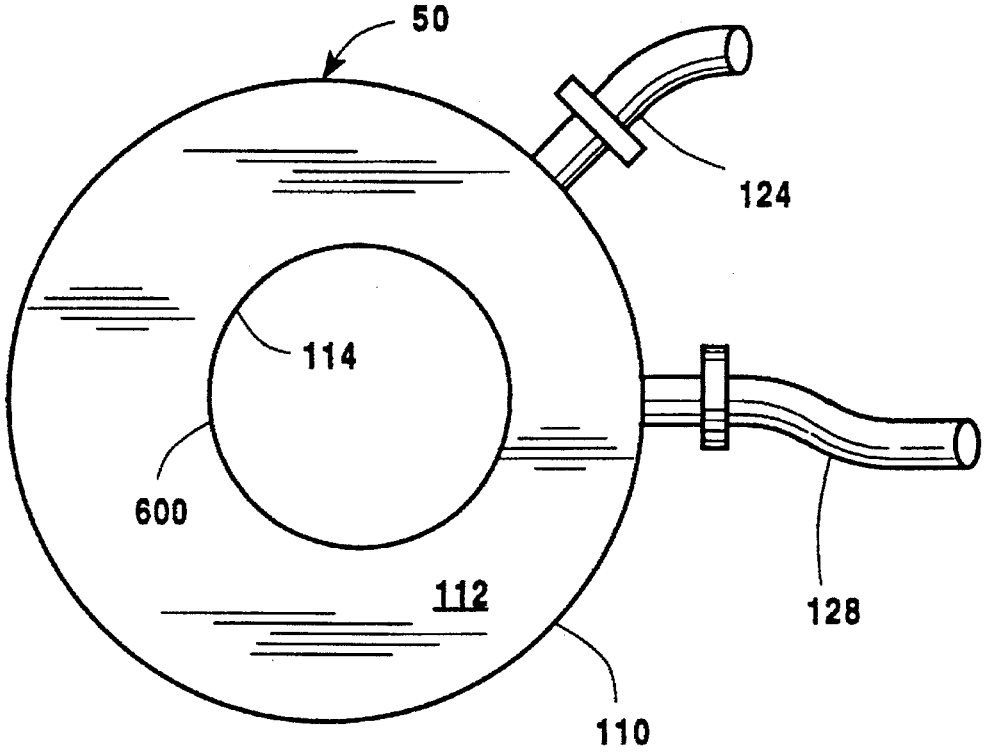

With reference to FIGS. 2–4, lower cover 40 comprises a hollow interior section 70 between its top wall 72 and bottom wall 74. Within interior space 70 a plurality of spoke-like cooling spray bars 76 which are connected to and receive coolant, e.g. water, from a ring shaped water supply manifold 78, which is supported by brackets 79 and is concentric with and surrounds opening 60 of lower cover 40 and is closely adjacent thereto, the spoke-like cooling spray heads 82 within space 70 depending downward and away from manifold 78. Downwardly directed spray heads 82 on manifold 78 spray liquid coolant against the inside 84 of the bottom wall 74 to maintain lower cover 40 at an acceptable temperature during furnace operation. Coolant is removed from the interior 70 of lower cover 40 at an acceptable temperature during furnace operation. Coolant is removed from the interior 70 of lower cover 40 via openings 86 in drain manifold 87 which is concentric with opening 60 and is located at the lowermost portion of interior section 70 of lower cover 40. A screen 88 prevents debris from entering drain manifold 87 and coolant exits drain manifold 87 by via discharge outlet 90 to drain line 92. Coolant is supplied to the spray heads 82 and spray bars 76 from supply manifold 78 which is closely adjacent inner opening 60 and remote from upstanding peripheral wall 100, receives coolant under pressure via inlet line 94 and pipe 21. The coolant exiting spray heads 82 into interior section 70 is no longer pressurized and after contacting bottom wall 74 to spent coolant exits lower roof 40 via drain manifold 87 as described hereinabove. Upstanding peripheral wall 100, upstanding inner wall 102, bottom wall 74 and top wall 104 define the enclosed annular space 70 within which the spray means comprising supply manifold 78, spray heads 82 and spray bars 76 are enclosed. Top wall 104 of lower cover 40 has a flat shelf-like portion 106 spaced inwardly from peripheral wall 100 and surrounding inner opening 60 of lower cover 40. Upper cover 50 rests slidably on the flat shelf-like portion 106 of lower cover 40 and is moveable in all directions. Upper cover 50 has an upwardly tapered bottom wall 108, an upstanding peripheral wall 110, a top wall 112 and an upstanding inner wall 114 which defines an enclosed annular space 116 and an opening 600 which closely surrounds electrode 20 and through which electrode 20 extends downwardly into furnace 10. Spray means comprising spray heads 182 and spray bars 176 and coolant header conduit 118 are disposed within annular space 116 and supported therein by brackets 120. Coolant header conduit 118 is closely adjacent and concentric with peripheral wall 110 and spaced from opening 600. Spray bars 176 extend inwardly toward opening 600 from coolant header conduit 118 about ⅔ to ¾ of the distance to opening 600. Coolant under pressure is provided to header conduit supply manifold 118 of upper cover 50 from header conduit supply manifold 78 of lower cover 40 by way of flexible hose 124. Header supply conduit 118 of upper cover 50 is closely adjacent upstanding peripheral wall 110 and remote from opening 600 of upper cover 50. Coolant exiting spray nozzles 176 is no longer under pressure and in the form of liquid droplets contacts upwardly tapered bottom wall 108 and spent liquid coolant is collected in the lowermost portion 126 of annular space 116 and exits upper cover 50 via flexible hose 128 and flows by gravity into interior space 70 of lower cover 40 by way of drain 130 which is positioned above screen 88 so that spent coolant from upper cover 50 enters drain manifold 87 of lower cover 40 and exits the lower cover 40 via discharge outlet 90, together with and in the same manner as spent coolant from lower cover 40. The lower most edge portion of 132 of upper cover rests in a substantially circumferential point contact on flat, shelf-like portion 106 of the top wall 104 of lower cover 40. Consequently, the hollow, relatively light upper cover 50 can be moved to accommodate various eccentric positions 165 for electrode 20 by sliding cover 50 on the flat shelf-like portion 106 of lower cover 40. Lifting of upper cover 50 is not necessary and it is not necessary to disconnect any coolant inlet or drain lines.

What is claimed is:

1. A cover assembly for an electric arc furnace, said cover assembly comprising a lower cover and an upper cover, said lower cover overlying the electric arc furnace and defining an inner opening in said lower cover through which an electrode extends vertically downward into said electric furnace; said lower cover comprising a bottom wall, an upstanding peripheral wall, an upstanding inner wall and a top wall defining an enclosed space, said top wall of the lower cover having a flat shelf-like portion spaced inwardly from said upstanding peripheral wall and surrounding said inner opening in said lower cover, said moveable upper cover being slidably seated upon said flat shelf-like portion; first spray means comprising a plurality of tubes coupled to spray nozzles disposed within said enclosed space of the lower cover; inlet means in the form of a header conduit in said enclosed space in said lower cover surrounding said inner opening for bringing a coolant to the tubes and spray nozzles in said enclosed space of the lower cover with the spray nozzles arranged to direct a spray of coolant onto at least the bottom wall of the lower cover; outlet means for removing the coolant from the enclosed space of the lower cover; said upper cover comprising an upwardly tapered bottom wall, an upstanding peripheral wall, an upstanding inner wall defining an inner opening in said upper cover through which an electrode extends vertically downward into said electric furnace; and a top wall defining an enclosed annular space for said upper cover; second spray means comprising a plurality of tubes coupled to spray nozzles disposed within said enclosed annular space of said upper cover; inlet means in the form of a header conduit in said enclosed annular space of said upper cover surrounding said inner opening for bringing a coolant to the tubes and spray nozzles in the enclosed annular space of said upper cover and said spray nozzles arranged to direct a spray of coolant onto at least the bottom wall of the upper cover; outlet means for removing the coolant from the enclosed space in the upper cover; said inner opening of said upper cover defining an opening; hose means connecting said header conduits of said first and second spray means so that said header conduit of said second spray means receives coolant from said header conduit of said first spray means; outlet means for removing coolant by gravity flow from the enclosed space of the upper cover; hose means connecting the outlet means of the upper cover with the outlet means of the lower cover; the lowermost portion of the upwardly tapered bottom wall of the upper cover resting slidably on the flat shelf-like portion of the top wall of the lower cover and being slidably moveable thereon in all directions.

2. Cover assembly in accordance with claim 1 wherein the header conduit in the enclosed space of the upper cover is spaced adjacent the upstanding peripheral wall of the upper cover and remote from the inner opening of said upper cover.

3. Cover assembly in accordance with claim 1 wherein the header conduit in the enclosed space of the upper cover is spaced adjacent the upstanding peripheral wall of the upper cover and remote from the inner opening of said upper cover, and wherein the inner opening of the upper cover is smaller than the inner opening of the lower cover and is closely adjacent to an electrode extending vertically downward therethrough.

4. Cover assembly in accordance with claim 1 wherein the header conduit in the enclosed space of the upper cover is spaced adjacent the upstanding peripheral wall of the upper cover and remote from the inner opening of said upper cover, and wherein the inner opening of the upper cover is smaller than the inner opening of the lower cover and is closely adjacent to an electrode extending vertically downward therethrough, and wherein the header conduit in the enclosed space of the lower cover is spaced adjacent the inner opening of said lower cover and remote from the upstanding peripheral wall of the lower cover.

* * * * *